United States Patent [19]

Tsuruta et al.

[11] Patent Number: 4,589,247

[45] Date of Patent: May 20, 1986

[54] APPARATUS FOR PREVENTING CREASES IN TRANSVERSE SEALING

[75] Inventors: Orihiro Tsuruta; Yasuo Oki; Yasugi Zinbo, all of Tomioka, Japan

[73] Assignee: Orihiro Co., Ltd., Japan

[21] Appl. No.: 649,894

[22] Filed: Sep. 12, 1984

[30] Foreign Application Priority Data

Mar. 27, 1984 [JP] Japan ..... 59-42725[U]

[51] Int. Cl.[4] ..... B65B 9/08; B65B 61/00

[52] U.S. Cl. ..... 53/550; 53/551

[58] Field of Search ..... 53/371, 451, 481, 550, 53/551, 552, 553, 554; 493/302, 308

[56] References Cited

U.S. PATENT DOCUMENTS

| | | | |
|---|---|---|---|
| 2,956,383 | 10/1960 | Gausman | 53/552 |
| 2,966,832 | 1/1961 | Vergobbi | 53/229 |
| 3,041,941 | 7/1962 | Danielzig | 53/373 |
| 3,045,404 | 7/1962 | Wilson | 53/551 |
| 4,103,473 | 8/1978 | Bast et al. | 53/551 |

*Primary Examiner*—Horace M. Culver

*Attorney, Agent, or Firm*—McGlew and Tuttle

[57] ABSTRACT

The invention provides an apparatus for transversely stretching a film tube at a portion to be transversely sealed and preventing creases from occurring in the transversely sealed portion of the film tube when a product fed in the film tube is separated by a squeeze roll means into a specified amount for one pack and thereafter the film tube is transversely sealed. Butterfly arms which pivotally spread apart in a fan-like manner are used for the stretching means.

3 Claims, 5 Drawing Figures

PRIOR ART
FIG. 1A
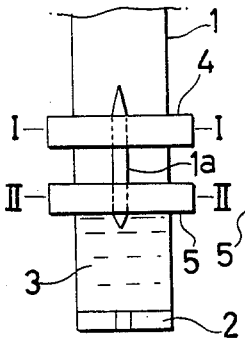
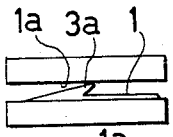
PRIOR ART
FIG. 1B
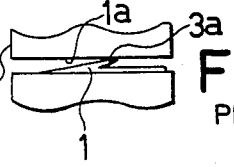
FIG. 1C
PRIOR ART
FIG.2
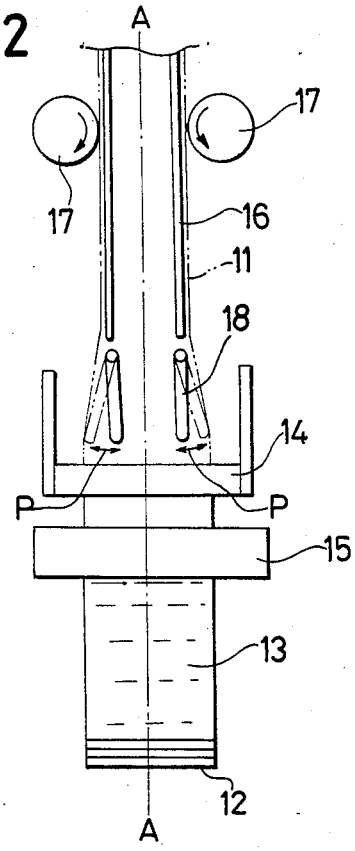
FIG.3
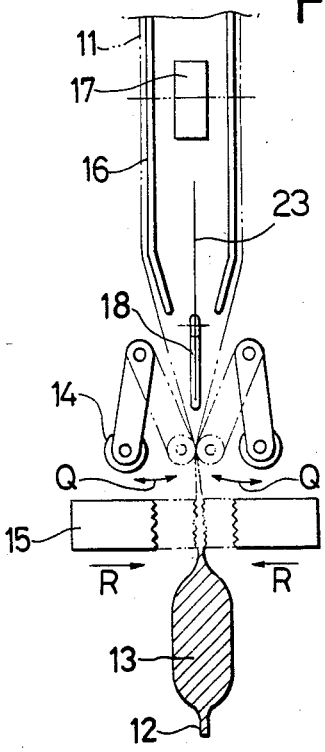

APPARATUS FOR PREVENTING CREASES IN TRANSVERSE SEALING

BACKGROUND OF THE INVENTION

1. Field of the Invention

The invention relates to an apparatus for preventing creases from occurring in transverse sealing in a vertical three way packing machine.

2. Prior Art

In a vertical three way packing machine of the prior art shown in FIGS. 1(A), 1(B) and 1(C), a product 3 is fed into a film tube 1 formed into tubular shape after the bottom portion thereof has been provided with a seal. The product 3 fed into the film tube 1 is separated into a predetermined quantity by means of a pair of squeeze rolls 4 exerting external pressure on the film tube 1 through rolling operation for a fixed period of time. The product 3 in the film tube 1 separated into the predetermined quantity is moved downward with the film tube 1 being pressed by the pair of squeeze rolls 4. When the squeezed portion of the film tube moved downward reaches the point where transverse sealing is performed, the film tube is held in the transverse sealing means 5 to be heated for transverse sealing to produce a pack of product 3 of predetermined quantity.

In the process using the above machine of the prior art, creases 1*a* tend to be created in the film tube 1 during squeezing and transverse sealing operations due to the weight of the product 3, slackening of the film tube 1 or the like. A small amount of product 3*a* may be retained in the creases without being squeezed out and, if the film tube 1 is transversely sealed as is in this condition by the transverse sealing means, may cause faulty sealing leading to possible leakage of the product.

BRIEF SUMMARY OF THE INVENTION

The object of the invention is to overcome the above disadvantage of the prior art and to provide an apparatus for preventing creases in transverse sealing, wherein a film tube is stretched sideways in the direction parallel to squeeze roll means by butterfly arms from inside the film tube at the same time as the film tube is held by the squeeze roll means from outside thereof, and sealed transversely after the film tube is held by the squeeze roll means, thereby preventing creases from occurring in the transversely sealed portion of the film tube.

The invention provides an apparatus for preventing creases in transverse sealing for use in a packing machine which comprises a feed roller means for lowering a film tube, a squeeze roll means disposed below said feed roller means for separating a product fed in the bottom of said film tube into a specified amount for one pack, and a transverse sealing means for transversely sealing said film tube, characterized in that butterfly arms are provided inside said film tube, said butterfly arms being operable between open and closed positions in the direction parallel to the axis of said squeeze roll means to spread apart downward in a fan-like manner in the open position and being adapted to stretch said film tube in the direction parallel to the axis of said squeeze roll means before said film tube is held by said squeeze roll means.

BRIEF DESCRIPTION OF THE DRAWINGS

FIGS. 1(A), 1(B) and 1(C) are partial sections of a vertical three way packing machine of the prior art, FIG. 1(B) showing a section taken along line I—I of FIG. 1(A), and FIG. 1(C) showing a section along line II—II of FIG. 1(A), FIG. 2 is a vertical section of an apparatus of the invention, and FIG. 3 is a section taken along line A—A of FIG. 2.

DETAILED DESCRIPTION OF THE INVENTION

The invention will now be described by way of an example with reference to the accompanying drawings. FIG. 2 is a vertical section of the apparatus of the invention, FIG. 3 being a section taken along line A—A of FIG. 2. As shown in these drawings, an inner tube 16 is arranged inside a film tube 11, a pair of feed rollers 17 being disposed outside the film tube 11 to feed the film tube downward. A pair of butterfly arms 18 are installed below the inner tube 16. The pair of butterfly arms are pivotably operable between the open and closed positions in the directions of arrows P to spread apart downward in the open position. The opening-and-closing operation of the pair of butterfly arms 18 can be performed by pulling action from the top of the inner tube 16 by means of a bar or wire 23 formining drive means. A pair of squeeze rolls 14 are provided outside the film tube 11 below the pair of butterfly arms 18. The pair of squeeze rolls are pivotally operable between the open and closed positions in the directions of arrows Q (transverse to arrows P) to converge downward in the closed position, being adapted to hold the film in the closed position. Further, a pair of transverse sealing means 15 are provided below the pair of squeeze rolls 14, the transverse sealing means 15 being constructed to close in the directions of arrows R (also transverse to arrows P) to be operable for transverse sealing through fusion sealing with heat.

The effectiveness of the operation of the apparatus of the invention will now be described. As shown in FIGS. 2 and 3, the film tube 12 is lowered along the outside of the inner tube 16 by the pair of feed rollers and transversely sealed at its bottom end, after which the product 13 is supplied through the inner tube 16, the film tube 11 being held by the squeeze roll means 14 from the outside thereof. However, in the apparatus of the invention, the butterfly arms 14 spread apart downward in the direction of the axis of the squeeze roll means 18 to stretch the film tube 12 transversely in the direction parallel to the axis of the squeeze roll means 18 before the film tube is held by the squeeze roll means 14. In this condition, the film tube 11 is held in the squeeze roll means 14 to separate the product 13 into the amount for one pack, after which it is lowered to a predetermined position to be held by the transverse sealing means 15 for fusion sealing with heat, thereby accomplishing production of a pack of product.

The opening-and-closing operations of the butterfly arms 18, squeeze roll means 14 and transverse sealing means 15 are performed in a timed sequence with the aid of a timer means or the like (not shown).

As described above, in the apparatus of the invention, since the film tube 11 is stretched from the inside by the butterfly arms 18 before being held by the squeeze roll means 14, creases in the film tube 11 are totally prevented from occurring while being held by the squeeze roll means 14, transverse sealing thereafter being perfectly accomplished by fusion sealing with heat, as a result of which leakage of the contents (product), rupture of the film tube or the like are completely prevented from occurring in the transversely sealed portion of the film tube.

What is claimed is:

1. An apparatus for preventing creases in a transverse seal and for a packing machine, comprising feed roller means for lowering a film tube, a pair of squeeze rollers rotatable about transverse axes disposed below said feed roller means for separating a product fed in the bottom of the film tube into a specified amount for one pack, said squeeze rollers being mounted for movement transversely to said transverse axes, toward the film tube to hold the film tube, transverse sealing means for transversely sealing the film tube along a direction parallel to said transverse axis, a pair of butterfly arms provided inside the film tube and mounted for movement between open and closed positions in a direction parallel to said transverse axes of said squeeze rolls, and drive means connected to said butterfly arms for spreading said arms into their open position to stretch the film tube in the direction parallel to the transverse axes before the film tube is held by said squeeze rollers.

2. An apparatus according to claim 2, wherein said butterfly arms are pivotally mounted at upper ends thereof for movement between their open and closed positions.

3. An apparatus according to claim 2, wherein said pair of squeeze rollers are pivotally mounted for movement toward and away from the film tube.

* * * * *